United States Patent [19]

Hyman, Sr.

[11] Patent Number: 4,606,266

[45] Date of Patent: Aug. 19, 1986

[54] COMBINATION CAN CRUSHING AND EXERCISING MEANS

[76] Inventor: James A. Hyman, Sr., 227 Olive St., Rocky Mount, N.C. 27801

[21] Appl. No.: 726,610

[22] Filed: Apr. 24, 1985

[51] Int. Cl.[4] ..... B30B 9/32

[52] U.S. Cl. ..... 100/233; 100/266; 100/295; 100/902; 272/96

[58] Field of Search ..... 100/902, 266, 233, 295; 272/96

[56]. References Cited

U.S. PATENT DOCUMENTS

| | | | |
|---|---|---|---|
| 2,466,907 | 4/1949 | Madolny | 100/902 X |
| 3,299,802 | 1/1967 | Black | 100/902 X |
| 3,776,129 | 12/1973 | Carlson | 100/233 X |
| 4,393,765 | 7/1983 | Accettura | 100/295 X |
| 4,459,905 | 7/1984 | Wilson | 100/233 X |

FOREIGN PATENT DOCUMENTS

| | | | |
|---|---|---|---|
| 540433 | 5/1957 | Canada | 272/96 |

*Primary Examiner*—Billy J. Wilhite
*Attorney, Agent, or Firm*—Mills and Coats

[57] ABSTRACT

This invention is a combination can crusher and exercise device. A spring loaded jaw means acts as an exerciser for the user thereof while at the same time being adaptable for use as a can crusher. The present invention has the additional feature of being self-adjustable for either short or tall cans, particularly cans of the beer and soft drink type.

7 Claims, 5 Drawing Figures

COMBINATION CAN CRUSHING AND EXERCISING MEANS

FIELD OF INVENTION

This invention relates to exercising devices and more particularly to combination exercise and compacting means.

BACKGROUND OF INVENTION

Since man first began using can type containers for holding and preserving foods and beverages, there has been a problem in disposing of the same since an empty can takes up the same amount of space in a trash bag as the can did when full.

With the proliferation of aluminum drink cans in the last few years, coupled with the shortage of aluminum to make the same, recycling has come into vague. Even on the side of highways, scavengers can be seen picking up cans for resale to recycling stations. Usually these cans are placed in large plastic bags which are both bulky to transport and to store.

One of the largest users of can type containers are bars and similar establishments which sell beer and soft drinks in cans. Quite often literally truck loads of "empties" as they are called are accumulated during any given day.

Also people who frequent bars quite often do not get adequate exercise which can lead to obesity as well as other physical problems.

BRIEF DESCRIPTION OF INVENTION

After much research and study into the above-mentioned problems, the present invention has been developed to provide a means for reducing can type containers to a compact state while at the same time given the user thereof exercise and allowing such user to become more mentally calm by taking frustrations out on the machine during the crushing process.

The above is accomplished through the provision of a device which is biased to an open, loading and unloading position and includes a jaw means having a crushing head portion. It ordinarily takes several blows of the foot manipulated jaw means crushing to reduce the average can to an acceptable compressed state. During this compression process, the user gets exercise in his legs, and because of the repeated blows often necessary, the user can take out of his frustrations on the machine. The can itself is reduced in volume by eighty percent or more thus more cans can effectively be transported and stored in the same space that one uncrushed can requires.

In view of the above, it is an object of the present invention to provide a foot-operated means for reducing can type containers to a compact size.

Another object of the present invention is to provide a compactor for can type containers which is automatically adjustable for different heights of containers.

Another object of the present invention is to provide a can type compacting device wherein the compacting head is adapted to carry advertising material.

Another object of the present invention is to provide a combination can crushing and exercising device.

Another object of the present invention is to provide a combination can crushing, physical exercise, and frustration relieving device.

Another object of the present invention is to provide a crushing means for can type containers which can be broken down into a compact configuration for shipment and yet when assembled is sturdy in structure.

Another object of the present invention is to provide a compacting device for can type containers which eliminates binding and/or jamming of the container within the crusher as a result of the crushing process.

Other objects and advantages of the present invention will become apparent and obvious from a study of the following description and the accompanying drawings which are merely illustrative of such invention.

DETAILED DESCRIPTION OF THE INVENTION

Figure 1:
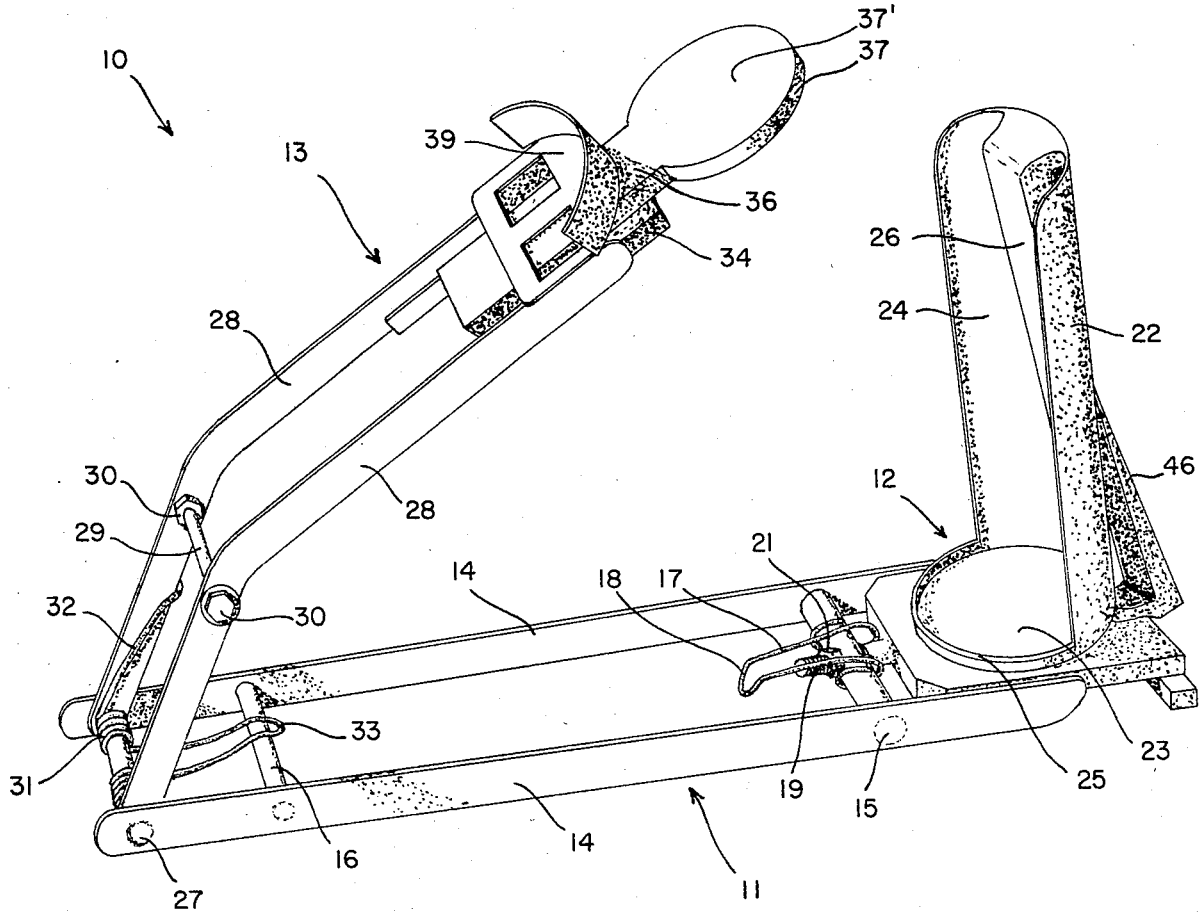
FIG. 1 is a perspective view of the combination can crusher and exerciser of the present invention.

With further reference to the drawings, the combination can crusher and exerciser of the present invention indicated generally at the numeral 10. As best seen in FIG. 1, the combination can crusher and exerciser includes a base 11 with a crushing block 12 secured to one end thereof and a crushing jaw 13 pivotally mounted on the opposite end.

The base 11 is constructed of two parallel side members 14 interconnected and held apart by a front spacing rod 15 and a rear spacing rod 16. Other methods of construction may be employed, such as stamping the base from sheet metal, without departing from the spirit of the invention.

Figure 2:
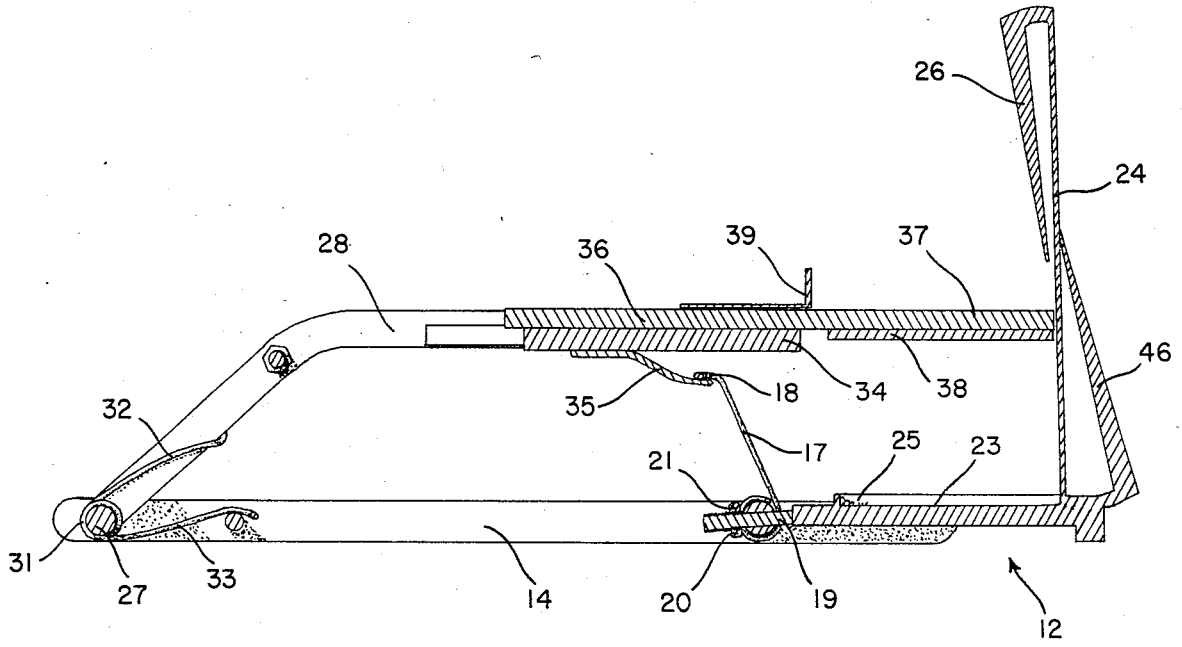
FIG. 2 is a longitudinal sectional view of the combination can crusher and exerciser.

A latch spring 17 having a hook portion 18 is securing to front spacing rod 15 and is movable between the downward or unlocked position as shown in FIG. 1 and the locked position as shown in FIG. 2. It is appreciated that latch spring 17 is biased toward the downward or unlocked position.

The crushing block 12 is preferably formed from metal and is disposed at the front of base 11 between side members 14. A stud 19 extends rearwardly from crushing block 12 through opening 20 in front spacing rod 15. A nut 21 threaded onto the free end of stud 19 secures crushing block 12 to base 11.

A can holder 22 is mounted on crushing block 12. The can holder 22 includes a circular base member 23 secured to crushing block 12 by any suitable means such as by weldment. A vertical, U-shaped member 24 extends around a portion of base member 23. A lip 25 extends around the remaining circumference of base member 23 and holds the can in place as will be hereinafter set forth in greater detail.

Figure 4:
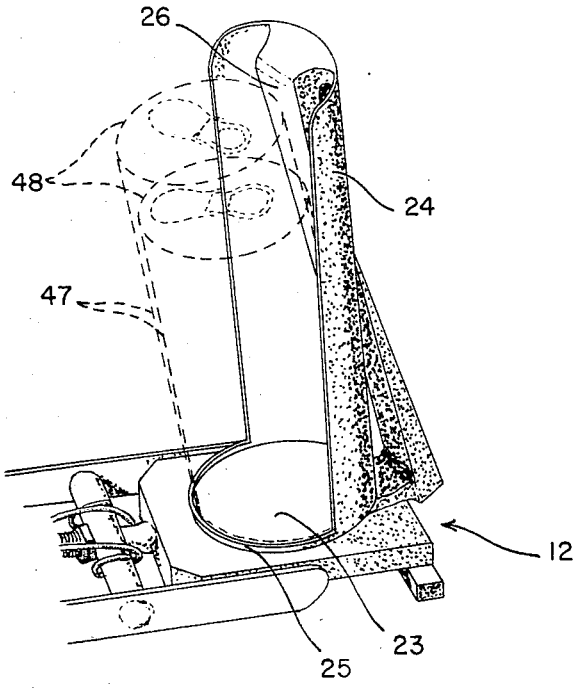
FIG. 4 is a detailed perspective view of the can holder portion of such invention.
Figure 3:
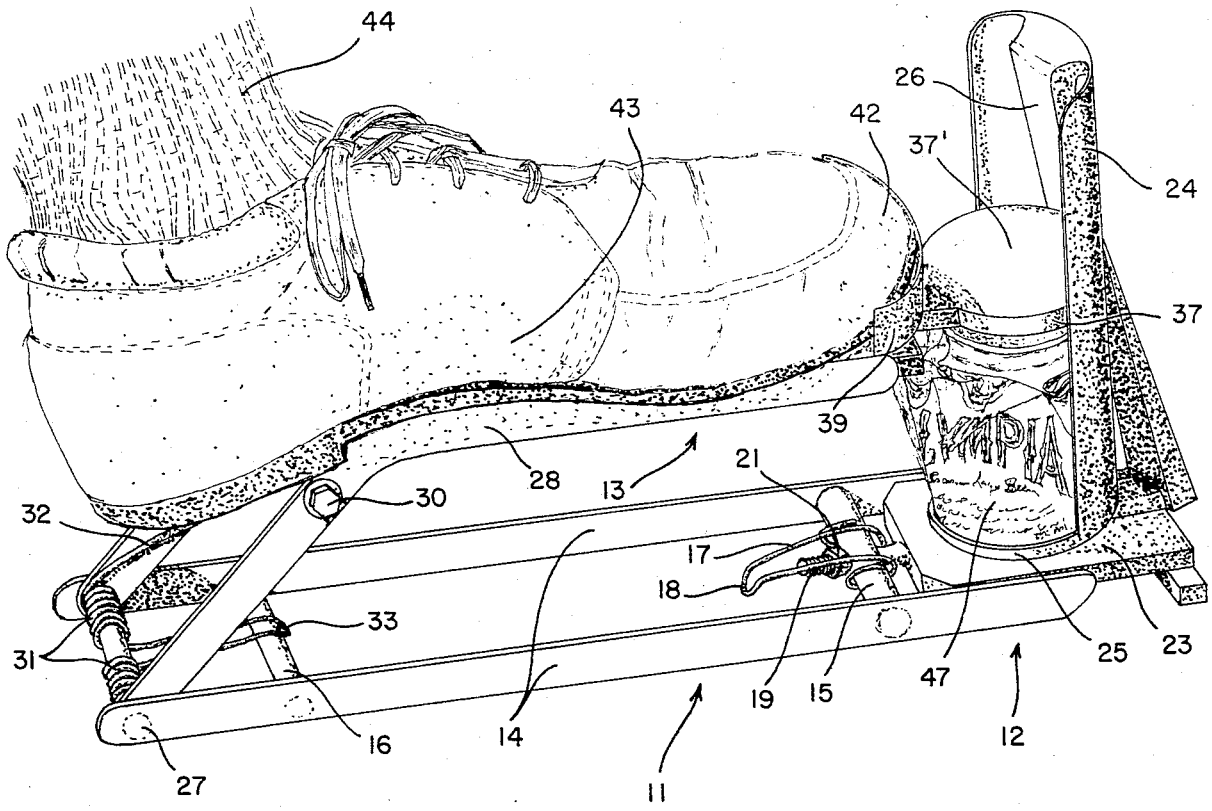
FIG. 3 is a perspective view of the present invention being used to crush a can.
Figure 5:
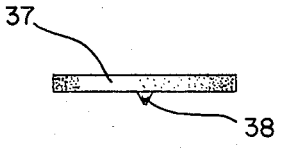
FIG. 5 is an end elevational view of the compacting head showing the V-shaped peen.

V-shaped member 24 is provided with a tilt member 26 which extends angularly from the top of the U-shaped member 24 to a point approximately midway thereof. The purpose of tilt member 26 is to tilt cans placed within can holder 22 to an optimum angle, depending on the height of the can, so that the crushing jaw 13 can engage the top of the can squarely regardless of its height as can clearly be seen in FIG. 4.

A bracing member 46 extends angularly from the crushing block 12 to a point approximately midway of the U-shaped member 26. This bracing member 46 provides said U-shaped member 26 with the necessary rigidity to resist the forces exerted during crushing operations.

The crushing jaw 13 is pivotally mounted on the rear of base 11 by pin 27 and is adapted to swing toward and away from base 11. This crushing jaw 13 constructed similar to base 11 and has two curved side members 28 interconnected by a threaded spacing rod 29. Four nuts 30 threaded onto spacing rod 29 holds the same in place as can clearly be seen in FIG. 1.

The crushing jaw is constantly urged to an upright position as shown in FIG. 1 by spring means, such as double sear spring 31 journaled about pin 27 and having arm portions 32 engaging each side member 28 of crushing jaw 13 with a central portion 33 engaging the rear spacing rod 16 of base 11.

A support block 34 is secured to the forward end of crushing jaw 13 between side members 8 by weldment or other suitable means. A catch 35 is secured underneath support block 34 and may be engaged by the hook portion 18 of latch spring 17 to hold the crushing jaw 12 in the downward position clearly shown in FIG. 2.

A metal crushing plate 36 is secured to the top of support block 34 by weldment or other suitable means. Crushing plate 36 includes a forwardly extending compacting head 37 having a peen 38 for engaging the top of a can 47 to deform the reinforced edge 48 thereof. Peen 38 has a V-shaped cross section and extends longitudinally along the lower surface of the compacting head 37.

The upper surface 37' of the compacting head 37 is adapted for carrying a logo or other advertising material of a sponsor.

A foot stop 39 is secured to the top of crushing plate 36 by any suitable means, such as by welding and is adapted to engage the toe 42 of the shoe 43 of the user 44 of the present invention.

The combination can crusher and exerciser is adapted to be used while situated on the floor for activation by the foot of the user 44, but it may equally be positioned on a table for activation by the hands of the said user.

To effect the crushing operation, a can 47 is situated upright within can holder 22. As previously noted, member 26 of can holder 22 will automatically tilt the can 47 toward the crushing jaw to a predetermined angle depending on the height of the can. As the crushing jaw is activated in the direction of the base 11, the V-shaped peen 38 first engages the rim or reinforced edge 48 of the can so that all of the forces are concentrated at that point with the result that the initial deformation of the reinforced edge is effected with a minimum of effort. On continued downward movement of the jaw 13, successively larger portions of the compacting head 37 engages the can to effect the desired crushing of the entire can.

During the crushing operation, shifting of the can is prevented by the U-shaped member 24 and rim 25.

When the crushing jaw 13 is pounded to the downward position, the can will be subtantially flattened and may be readily removed when the applied forces are released and the crushing jaw 13 is urged into an upright position by spring 31.

In addition to the obvious benefit of compacting recyclable cans for storage, the successive operation of the combination can crusher and exerciser of the present invention can provide the user the benfits of exercise while at the same time providing a harmless release for the user's frustrations.

After the crushing operation is completed, the combination can crusher and exerciser can be folded up for compact storage. This is accomplished by lifting latch spring 17 into an upright position and then pushing crushing jaw 13 into a downward or crushing position. When the latch spring 17 is released, the hook portion 18 thereof will engage catch 35 thus holding crushing jaw in the downward position. In addition, the crushing block 12 and can holder 22 can be removed by unthreading nut 21 and sliding crushing block 12 from between side members 14 of base 11.

What is claimed is:

1. A combination can crushing and exercising means comprising: a base means; means for supporting a can on said base; a jaw means pivotally mounted to said base remote from said can supporting means and having swinging movement toward and away from said base means; means for urging said jaw means away from said base means; means associated with said can supporting means for tilting a can in the direction of said jaw means at a predetermined angle depending on the height of the can; and means associated with said jaw means for engaging and crushing the can as said jaw means is moved in the direction of the base means whereby a combination can crusher, physical exerciser and frustration reliever is provided.

2. The combination can crusher and exerciser of claim 1 wherein said can supporting means includes a lip to prevent shifting of the can while the same is being crushed.

3. The combination can crusher and exerciser of claim 1 wherein said means for urging said jaw means away from said base is a spring means operatively disposed between said base means and said jaw means.

4. The combination can crusher and exerciser of claim 3 wherein said spring means is a sear type spring.

5. The combination can crusher and exerciser of claim 1 wherein the means for engaging and crushing the can includes a surface for affixing an advertising logo thereto.

6. The combination can crusher and exerciser of claim 1 wherein the means for engaging and crushing the can includes a V-shaped peen for engaging and deforming a reinforced edge of the can.

7. The combination can crusher and exerciser of claim 1 wherein said jaw means includes a toe engaging foot member mounted thereon.

* * * * *